US010350133B2

(12) United States Patent
Dahlor et al.

(10) Patent No.: US 10,350,133 B2
(45) Date of Patent: Jul. 16, 2019

(54) METHOD, SYSTEM AND APPARATUS FOR TREATING MYOFASCIAL AND MUSCULOSKELETAL TISSUE IMBALANCES USING A SOFT TISSUE MOBILIZING DEVICE THAT CAN BE MANUALLY LIFTED AND SHIFTED FOR NORMALIZING MYOFASCIAL AND MUSCULOSKELETAL TISSUE IMBALANCES

(71) Applicants: Frank Dahlor, Monterey, CA (US); Will Kramer, Monterey, CA (US); Horace J. Ferrante, Monterey, CA (US)

(72) Inventors: Frank Dahlor, Monterey, CA (US); Will Kramer, Monterey, CA (US); Horace J. Ferrante, Monterey, CA (US)

( * ) Notice: Subject to any disclaimer, the term of this patent is extended or adjusted under 35 U.S.C. 154(b) by 748 days.

(21) Appl. No.: 14/802,887

(22) Filed: Jul. 17, 2015

(65) Prior Publication Data

US 2016/0184172 A1 Jun. 30, 2016

Related U.S. Application Data

(60) Provisional application No. 62/026,192, filed on Jul. 18, 2014.

(51) Int. Cl.
*A61H 7/00* (2006.01)

(52) U.S. Cl.
CPC ..... *A61H 7/001* (2013.01); *A61H 2201/165* (2013.01)

(58) Field of Classification Search
CPC ..... A61H 9/0057; A61H 2205/108; A61H 2201/105; A61H 2201/0153; A61H 2201/1685; A61H 2009/0064; A61H 2205/102; A61H 1/02; A61H 1/00; A61H 11/00; A61H 2201/169; A61H 9/00; A61H 9/005; A61H 2009/006; A61H 2201/1253; A61H 7/001; A61H 2201/165
See application file for complete search history.

(56) References Cited

U.S. PATENT DOCUMENTS

2002/0156423 A1* 10/2002 Tollini ..... A61M 25/02 604/180
2002/0193724 A1* 12/2002 Stebbings ..... A61L 15/24 602/54

(Continued)

*Primary Examiner* — Loan B Jimenez
*Assistant Examiner* — Shila Jalalzadeh Abyaneh
(74) *Attorney, Agent, or Firm* — JRG Attorneys at Law

(57) ABSTRACT

An apparatus for treating myofascial and/or musculoskeletal tissue imbalances. The apparatus comprises a soft tissue mobilizing device having a front surface and a back surface. The back surface has an adhesive to adhere the device directly to the soft tissue area of a patient's body where muscle tension, aches and pain are present. The device when applied decompresses the soft tissue area being treated. The front surface includes a tab gripping mechanism to allow the patient or a therapist to grip the tab for manually lifting and shifting the soft tissue area under the mobilizing device being treated. The manual lifting and shifting of the patient's soft tissue reduces the time period for normalizing the myofascial and/or musculoskeletal tissue area being treated.

8 Claims, 10 Drawing Sheets

(56) References Cited

U.S. PATENT DOCUMENTS

| | | | | |
|---|---|---|---|---|
| 2006/0094998 | A1* | 5/2006 | Gorton | A61M 25/02 602/42 |
| 2015/0313788 | A1* | 11/2015 | Conte | A61H 9/0057 601/6 |

* cited by examiner

METHOD, SYSTEM AND APPARATUS FOR TREATING MYOFASCIAL AND MUSCULOSKELETAL TISSUE IMBALANCES USING A SOFT TISSUE MOBILIZING DEVICE THAT CAN BE MANUALLY LIFTED AND SHIFTED FOR NORMALIZING MYOFASCIAL AND MUSCULOSKELETAL TISSUE IMBALANCES

PRIORITY CLAIM

This non-provisional application claims priority to Provisional Patent Application Ser. No. 62/026,192, entitled "A Method, System and Apparatus for Treating Myofascial and Musculoskeletal Tissue Imbalances Using a Soft Tissue Mobilizing Device that can be Manually Lifted and Shifted for Normalizing Myofascial and Musculoskeletal Tissue Imbalances", filed on Jul. 18, 2014.

TECHNICAL FIELD

The present invention relates to the field of manual treatment, facilitation for assessing, diagnosing and treating dysfunction, abnormality or injury associated with soft tissue, specifically myofascial and/or musculoskeletal imbalances by using a soft tissue mobilizing device having a tab gripping mechanism for reducing the time period of normalizing myofascial and musculoskeletal tissue imbalances.

BACKGROUND OF THE INVENTION

One important area of the body that is often overlooked and/or neglected while treating injuries is the musculoskeletal system and myofascial tissue. The musculoskeletal system includes the connection of muscles with the skeleton, spine, brain and the connective tissues bridging these organs and structures together. Myofascial tissue pertains to the fibrous tissues called fascia (i.e., soft tissue) that encloses and separates layers of muscle. Further, muscles and their connective tissue connect different portions of the skeleton from the top of the head down through the torso and all the way to the feet.

Myofascial and musculoskeletal injuries occur in a variety of ways. Accidents, falls, poor body mechanics, poor posture, stress from everyday activities, tension, improper exercise regiments, and age related degeneration relate to some of the factors that cause these types of injuries directly or indirectly. When the human body is adversely affected by a soft tissue injury (i.e., myofascial/musculoskeletal) the body's central nervous system, which consists of the brain and spinal cord, receives a pain message that is detected by nerve receptors called nociceptors.

After the body's central nervous system receives a pain message, it attempts to protect the injured location by sending a signal to the surrounding muscle to guard itself and sustain a static position to avoid shear force. In other words, the surrounding muscle is forced to work harder to protect the injured area, which produces tensional imbalances on the body tissues of the musculoskeletal system which can create contracture and compression on such tissues causing the systems of the body to decalibrate from their naturally balanced state. A contracture is the shortening of soft tissue and could occur in a muscle, tendon, ligament, or fasciae.

If the musculoskeletal system and/or soft tissue injury locations are left unattended, the connective tissue will progressively contract, stick or glue to itself even when the connected muscle is stretched. Contracted connective tissue can therefore contribute to decalibration of the musculoskeletal system from its natural state causing tensional imbalances. As an imbalance occurs in one area of the body, the contracture of muscular and connective tissues imparts similar imbalances in the surrounding areas. What can occur then is a chain reaction of tissue contractions that can spread from a single point to several points along the length of the body perpetuating imbalances throughout the body.

The result of tensional imbalances related to soft tissue injuries can often manifest themselves as physical pain. In order to break the pain cycle, an external intervention must be introduced to stimulate release of these tensional imbalances, in order to decrease muscle tension. Currently, one type of therapy used to treat myofascial and musculoskeletal imbalances and/or tension is myofascial release therapy.

Myofascial release is a form of soft tissue therapy used to treat somatic dysfunction and the resultant pain and restriction of motion. The direct myofascial release (or deep tissue work) method engages the myofascial tissue (tension). The tissue is loaded with a constant force until release occurs. Practitioners use knuckles, elbows, forearm or other compressive tools and postural tapes to slowly stretch the restricted fascia by applying a few kilograms-force or tens of newtons. Direct myofascial release is an attempt to bring about changes in the myofascial structures by stretching or elongation of fascia, or mobilizing adhesive tissues.

Indirect myofascial release involves a gentle stretch, with only a few grams of pressure, which allows the fascia to 'unwind' itself. The dysfunctional tissues are guided along the path of least resistance until free movement is achieved. Moreover, this technique involves a slow stretch of the fascia until reaching a barrier and/or restriction. As the barrier and/or restrictions releases, the hand will feel the motion and softening of the tissue. The key to this technique is sustained pressure over time.

Currently, postural or prosthetic tapes are used to treat myofascial and/or musculoskeletal conditions by applying the tape directly to the affected area. The tape will remain on the affected area for a select amount of time to bring myofascial and/or musculoskeletal tissue back to normal. This technique is passive because the tape remains on the affected area without any further manipulation of the tape. In fact, one problem associated with this technique is that it does not allow a physical therapist and/or patient to lift and/or shift the tape by hand in order to speed up the process of bringing the myofascial and/or musculoskeletal tissue back to normal.

In light of the shortcomings in the prior art, there is a need for a soft tissue mobilizing device to replace outdated postural and/or prosthetic tapes that includes a tab gripping mechanism for allowing a physical therapist, patient or the like to lift and shift the device by hand via a flossing (i.e., pulling, shifting, stretching) motion in order to speed up the time period of bringing myofascial and/or musculoskeletal tissue back to normal.

BRIEF SUMMARY OF THE INVENTION

One aspect of the present invention is to provide an apparatus for treating myofascial and/or musculoskeletal tissue imbalances that is comprised of a soft tissue mobilizing device having a front surface and a back surface; the back surface having an adhesive for allowing the device to be applied directly to a soft tissue area of a patient's body where muscle tension, aches and pain are present, wherein the applied device decompresses the soft tissue area being treated; the front surface including a tab gripping mechanism for allowing the patient or a therapist to grip the tab for manually lifting and shifting the soft tissue area being treated, wherein the manual lifting and shifting enhances relief of myofascial and/or musculoskeletal tissue imbalances; and the manual lifting and shifting of the soft tissue reduces the time period for normalizing the myofascial and/or musculoskeletal tissue area being treated.

Another aspect of the present invention is to provide a method for treating myofascial and/or musculoskeletal imbalances, the method comprises the following steps of selecting a soft tissue area of a patient's body to be treated where the patient experiences muscle tension, aches, and pain; applying a soft tissue mobilizing device directly to the soft tissue area selected where the patient experiences myofascial and/or musculoskeletal tissue imbalances; decompressing the soft tissue area being treated with the applied device; manually lifting and shifting the device, where the manual lifting and shifting enhances relief of myofascial and/or musculoskeletal tissue imbalances; and normalizing the myofascial and/or musculoskeletal tissue area being treated by manually lifting and shifting the soft tissue, wherein the normalizing time period is reduced.

An additional aspect of the present invention is to provide a system for treating myofascial and/or musculoskeletal imbalances, the system is comprised of a soft tissue mobilizing device for: applying directly to a selected soft tissue area where a patient experiences myofascial and musculoskeletal tissue imbalances; decompressing the soft tissue area being treated; manually lifting and shifting the soft tissue area, wherein the manual lifting and shifting enhances relief of myofascial and musculoskeletal tissue imbalances; and normalizing the myofascial and musculoskeletal tissue area being treated by manually lifting and shifting the soft tissue, wherein the normalizing time period is reduced.

In one embodiment of the invention, the apparatus is used for treating multiple points on a patient's body, and is oriented to the specific somatic chain being treated allowing for closed chain, multi-dimensional releases on several plains and corrections of the tissue matrix.

In another embodiment of the present invention, the apparatus is used for treating surgical scar tissue release, i.e., shoulder, abdomen, hip, knee, pelvic, breast, plantar fasciitis, shin splints, patellar tracking problems, quadriceps/VMO disengagement, piriformis syndrome, postural imbalances, spinal imbalances, extremity imbalances and lower back. Of course, the areas of treatment are not limited to just the areas referenced above, but are only being disclosed for pedagogical purposes.

The present invention further provides a new device that has the following benefits: decreased chronic pain related to orthopedic conditions; allows for independent self-care; increased privacy; decreased health care costs; increased enjoyment and benefit by a user regarding all activities the user performs throughout the day; enhance other treatment strategies such as acupuncture, massage, chiropractic, and physical therapy; normalize tissue tone of the spine, diaphragm and extremities; improve core posture via realigned Somatic chain; increase endurance; increase work wages; improve exercise performance, and better travel tolerance.

The present invention also provides a new device that elevates the epidermis; separates the myofascial matrix; decompresses connective tissue, neural plexus and circulatory plexus; facilitates and encourages functional neuromuscular patterning; heightens somatic proprioception; transmits an exteroceptive stimuli; normalizes abnormal movement patterns; normalizes abnormal resting and active tension of myofascial tissue; and the new device lifts, pulls, isolates, stretches, shifts, expands, disentangles and stabilizes myofascial and musculoskeletal tissue imbalances.

The present invention additionally provides a form of soft tissue therapy that can be used to treat somatic dysfunction and the resultant pain and restriction of motion.

In a further embodiment of the present invention, a form of soft tissue therapy is provided that relaxes contracted muscles, increases circulation, lymphatic drainage, stimulates the stretch reflex of muscles and the overlying fascia.

One aspect of the present invention is to provide a method of soft tissue therapy for removing or breaking up fibrous (soft tissue) adhesions by allowing a patient or a therapist to utilize a soft tissue mobilizing device that can be lifted and shifted via a flossing motion for administering a constant force to an affected soft tissue area until relief occurs.

In another aspect of the present invention, the soft tissue mobilizing device is applied directly to an area of the body where a patient is experiencing myofascial and/or musculoskeletal tissue imbalances for bringing about body-wide balance of minimal tension; enhancing movement ability; helping to decompress joints; enabling fascia to glide and slide relative to each other as nature intended; creating ease in the body of effortless movement; and improving tissue tone and proprioceptive feedback for movement control.

Still yet another aspect of the present invention, a soft tissue mobilizing device is applied directly to an area of the body where a patient is experiencing myofascial and/or musculoskeletal tissue imbalances for bringing about harmony to the body as a whole by reeducating the body into efficient sustaining patterns for both posture and movement; providing greater ease, fluidity and efficiency in movement; raising body awareness; improving breathing and performance; preventing injury; and promoting health and well-being.

Consequently, for a better understanding of the present invention, its functional advantages and the specific objects attained by its uses, reference should be made to the accompanying drawings, claims and descriptive matter in which there are illustrated preferred embodiments of the invention.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
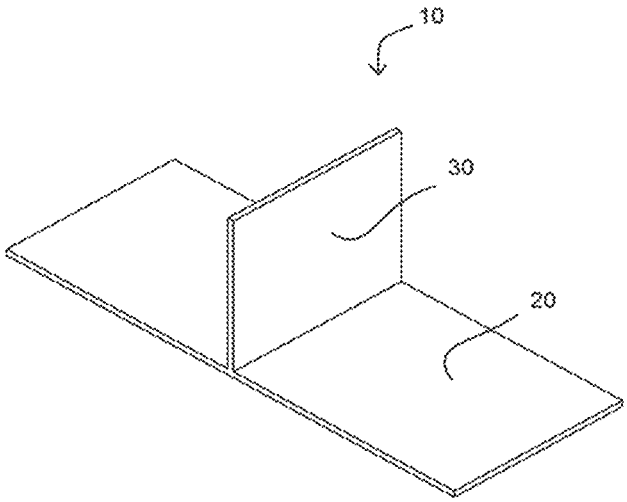
FIG. 1 is a top perspective view of the front surface of the soft tissue mobilizing device.
Figure 2:
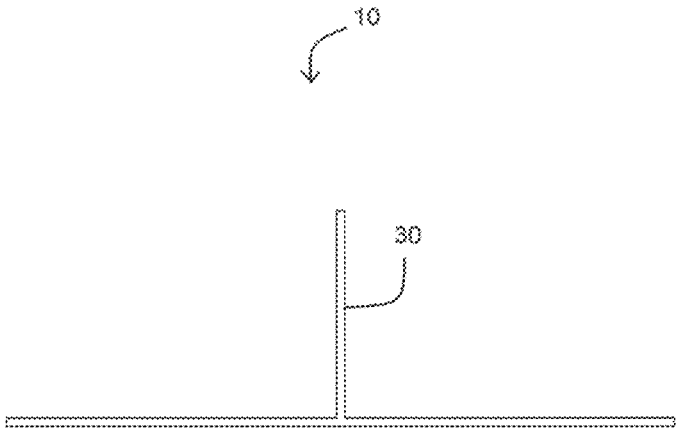
FIG. 2 is a front side view illustrating the tab gripping mechanism disposed substantially on the front surface of the soft tissue mobilizing device. The back side view is not illustrated but is a mirror image of the front side view.

Referring now to the drawings, FIG. 1 refers to a soft tissue mobilizing device 10 used for treating myofascial and/or musculoskeletal tissue imbalances. The device 10 will be comprised of a front surface 20. The front surface 20 will include a tab gripping mechanism 30 as depicted in FIG. 2. The tab gripping mechanism 30 will allow a patient, a physical therapist, a physician and/or the like to grip the tab 30 for manually lifting and/or shifting the soft tissue area being treated.

Figure 5:
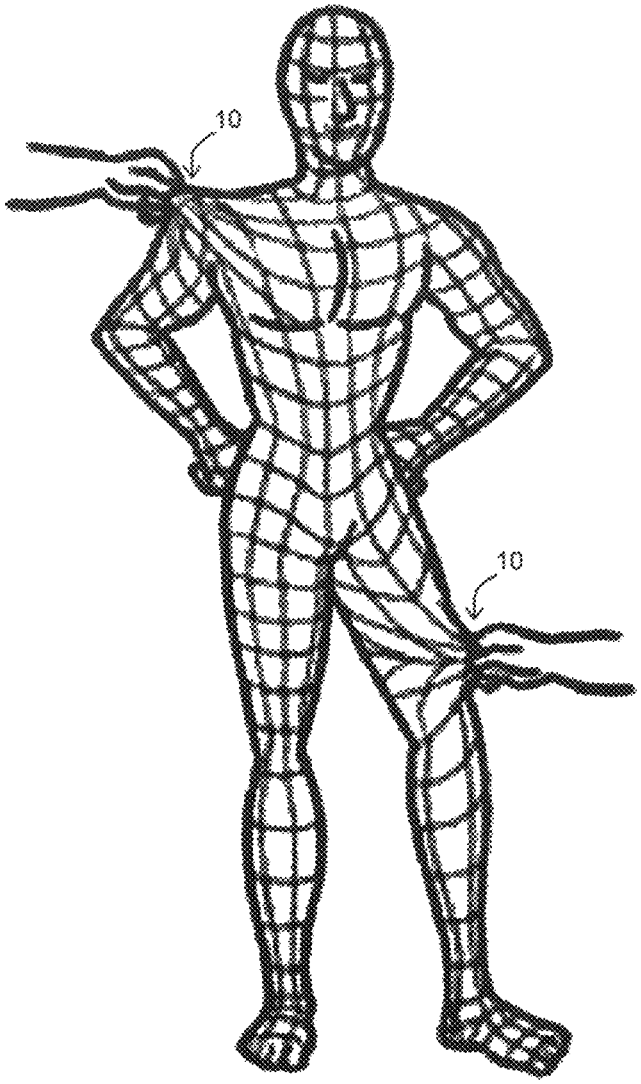
FIG. 5 is a front view illustrating the soft tissue mobilizing device being manually lifted and/or shifted for treating multiple points on the tissue matrix of a person's body.
Figure 6A:
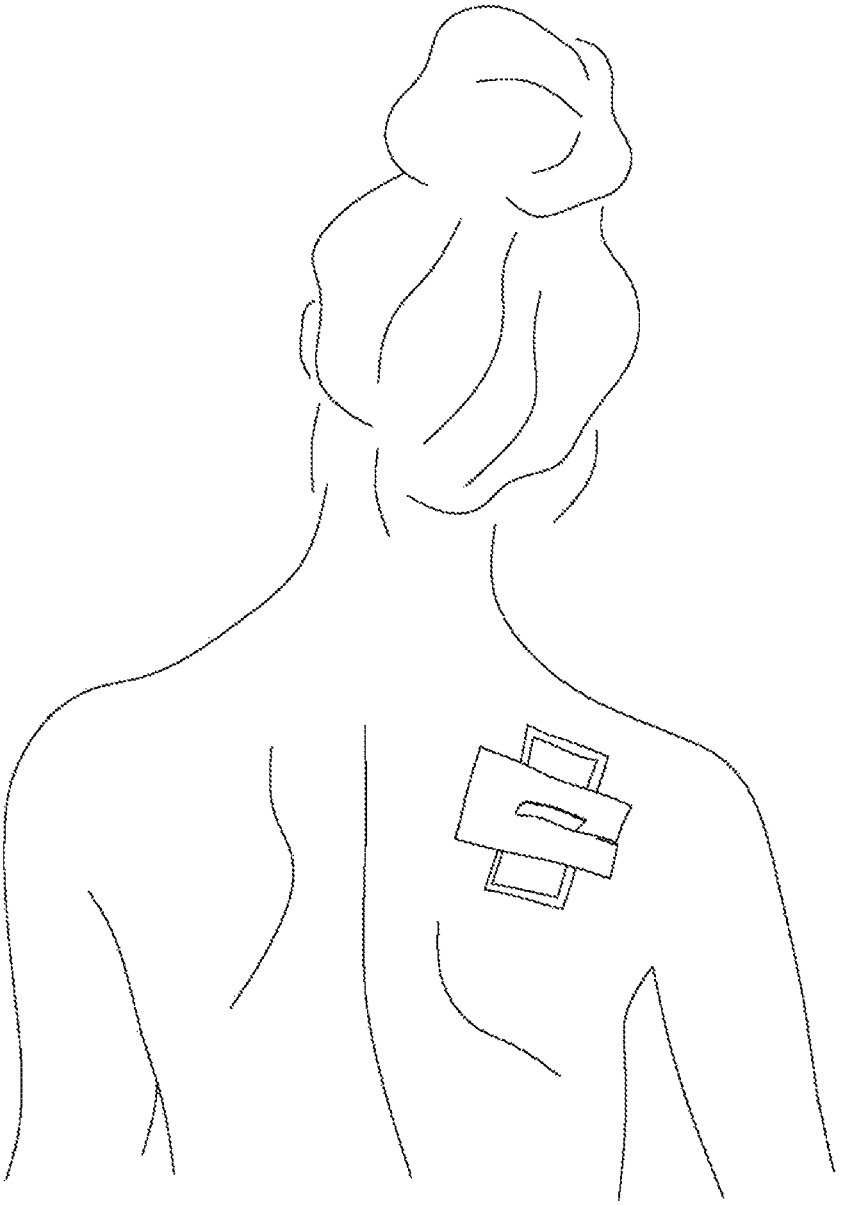
Figure 6B:
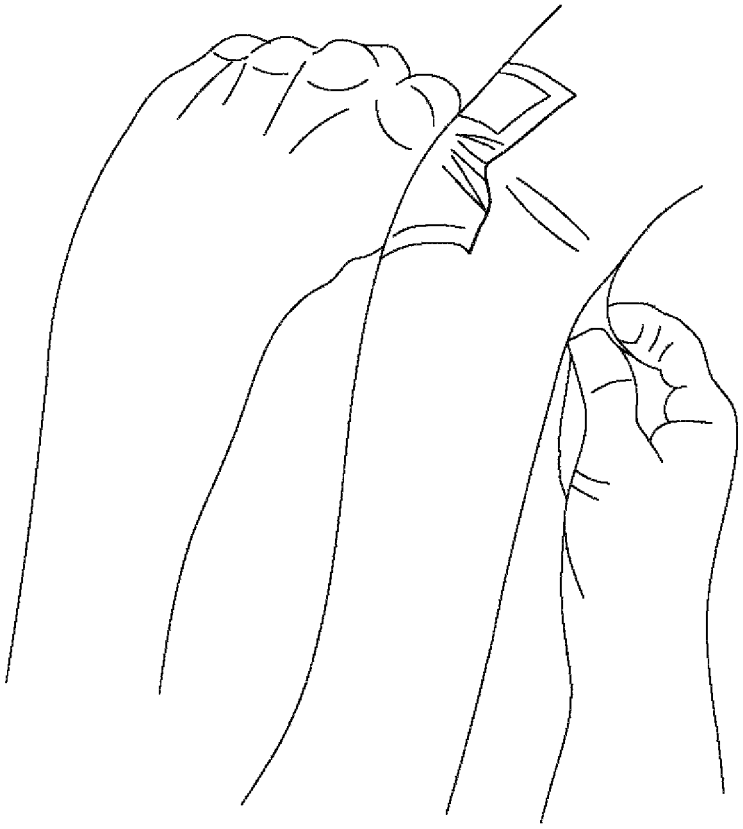
Figure 6C:
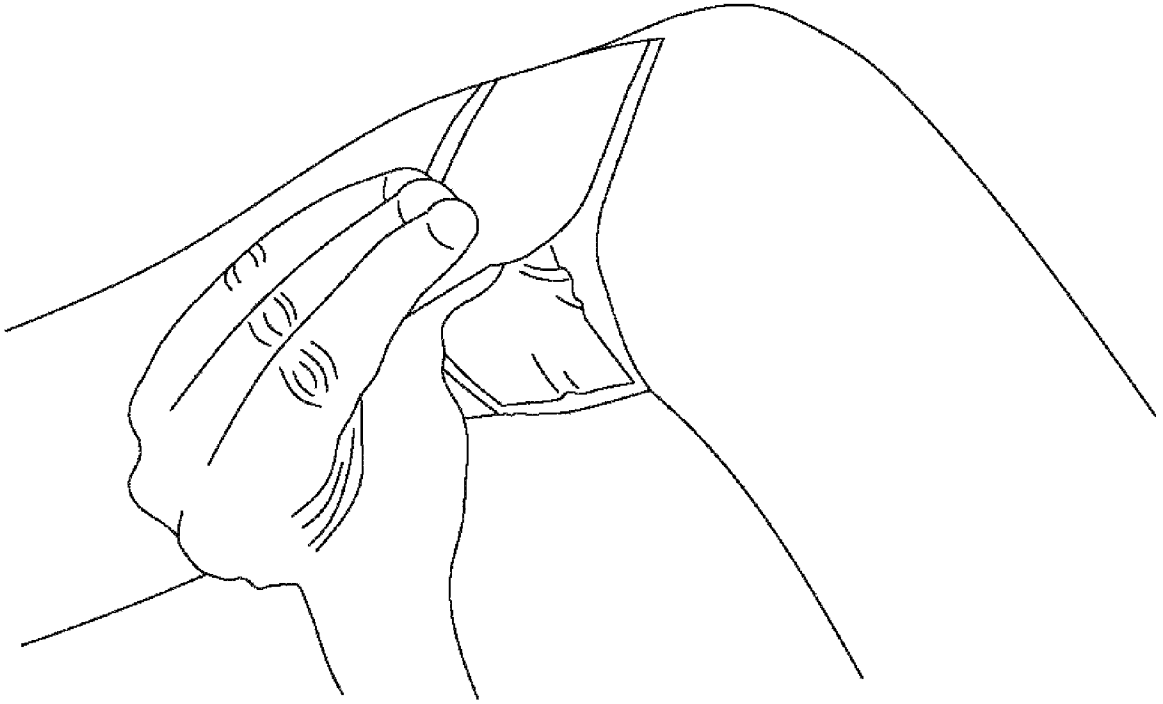
Figure 6D:
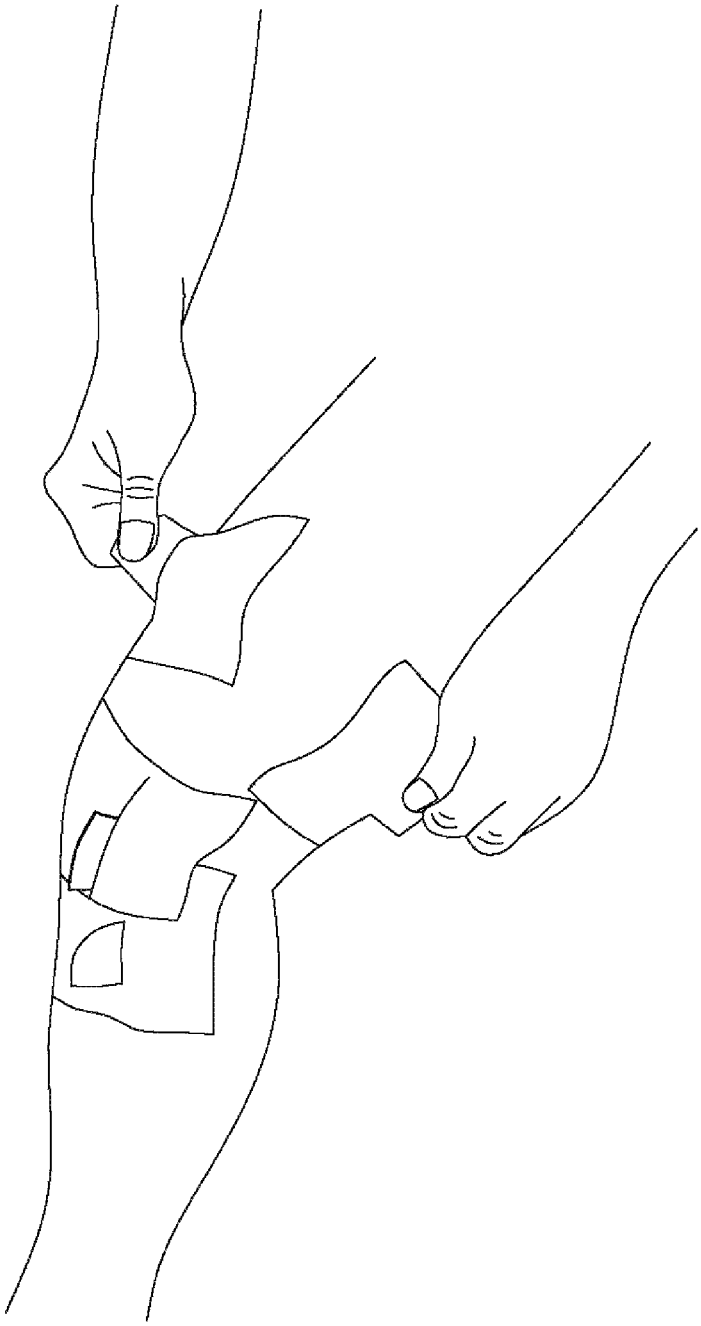
Figure 6E:
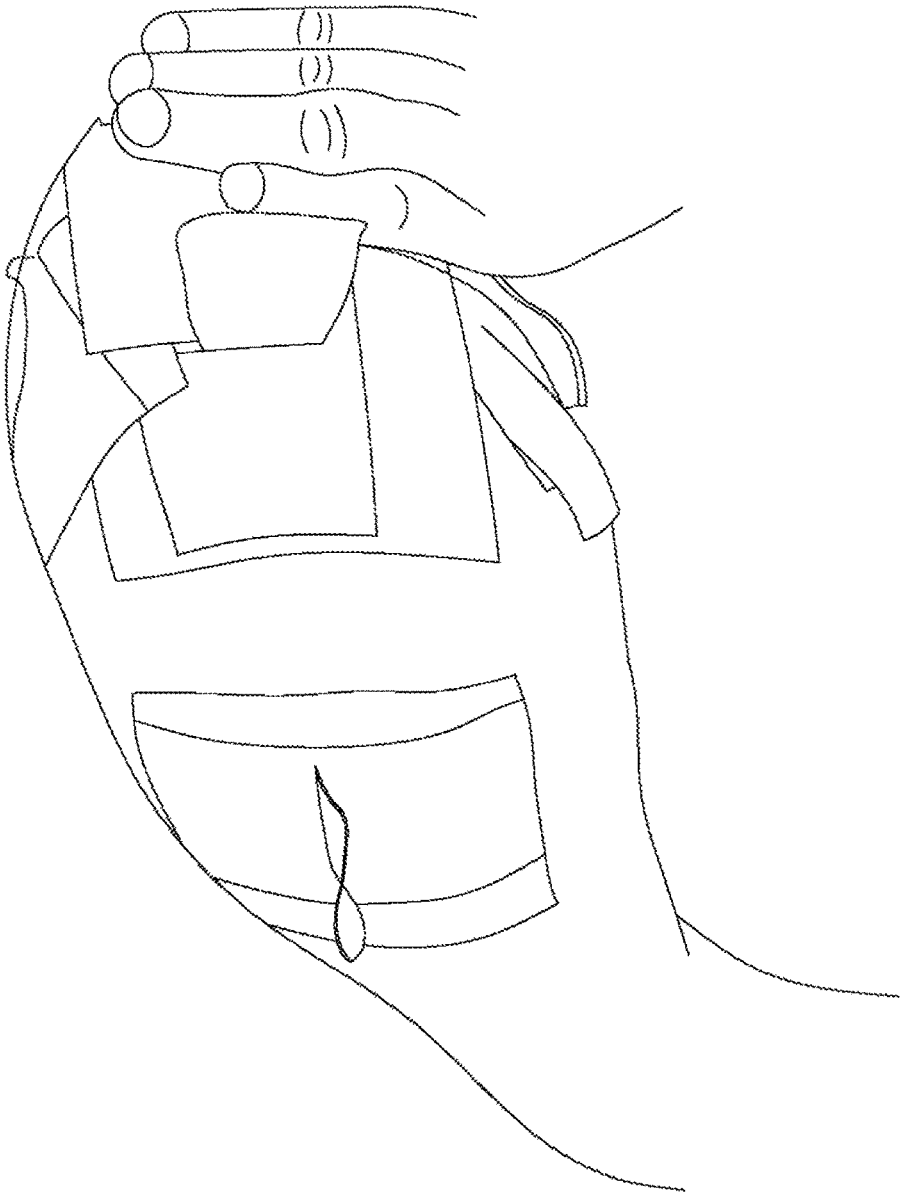

The manual lifting and/or shifting of a patient's tissue fiber is also referred to as tissue flossing. The term tissue flossing relates to a reciprocal pulling or decompressing movement through the tissue fibers of a person that is not limited to a single linear plane as depicted in FIG. 5. Moreover, the term fascial impingement refers to a dysfunctional fascial component that has a negative effect upon, a negative impression upon, or encroaching upon normal and healthy myofascial fibers. Similarly, the terms myofascial and musculoskeletal imbalances are also referred to as myofascial imbalances that cause muscle tension, aches, and pains.

One embodiment of the invention is comprised of a tape-like device or a patch-like device but is not limited to these specific types of embodiments. In addition, the size and shape of the mobilizing device 10 will vary depending on the specific area of the patient's body being treated. Further, the size and shape of the tab gripping mechanism 30 can vary as well but will not depart from the spirit and scope of the invention if the tab 30 is used for manually lifting and/or shifting the soft tissue area of a patient's body in order to treat myofascial and/or musculoskeletal tissue imbalances.

Figure 3:
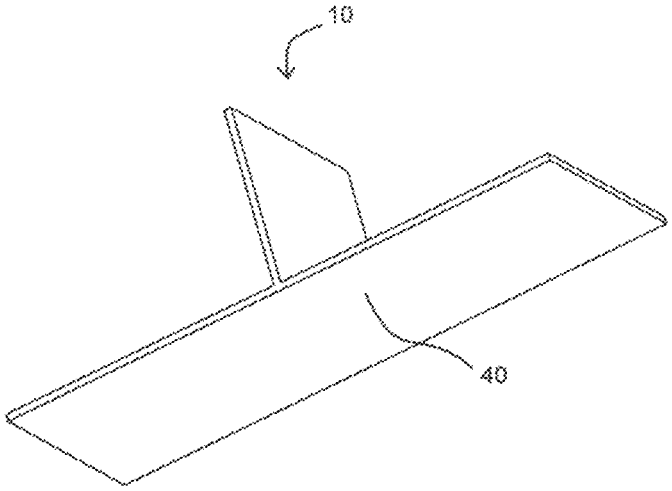
FIG. 3 is a bottom perspective view of the soft tissue mobilizing device.
Figure 4:
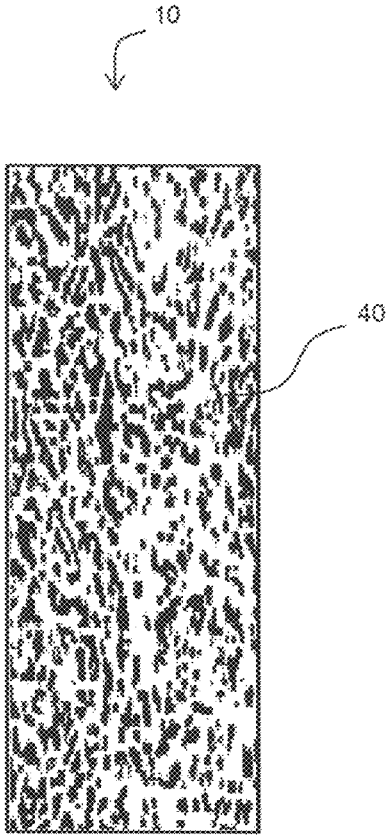
FIG. 4 is a top view of the back surface of the soft tissue mobilizing device.

Referring now to FIG. 3, the soft tissue mobilizing device 10 has a back surface 40. The back surface 40 includes an adhesive as shown in FIG. 4 for allowing the device 10 to be applied directly to a soft tissue area of the patient's body where muscle tension, aches and pain are present. The adhesive located on the back surface 40 also has an adhesive and cohesive strength that will vary depending on the amount of force required to treat a patient's myofascial and/or musculoskeletal tissue imbalances. Further, the type of adhesive used on the back surface 40 can vary as well.

FIG. 5 refers to the body's soft tissue matrix which depicts how a patient can manually lift and/or shift their soft tissue fiber when using the mobilizing device 10 for achieving relief from chronic muscle aches and pains when used as recommended.

It should be understood that the foregoing relates to exemplary embodiments of the invention and that modifications may be made without departing from the spirit and scope of the invention. It should also be understood that the present invention is not limited to the designs mentioned in this application and the equivalent designs in this description, but it is also intended to cover other equivalents now known to those skilled in the art, or those equivalents which may become known to those skilled in the art in the future.

What is claimed is:

1. A method for treating myofascial tissue imbalances, the method comprising the following steps:

selecting a soft tissue area of a patient's body to be treated where the patient is experiencing muscle tension, aches, and pain;

applying a soft tissue mobilizing device to the soft tissue area selected where the patient is experiencing the myofascial tissue imbalances, wherein the mobilizing device includes a front surface and an opposite back surface, the front surface having a gripping tab, the back surface being uniformly flat and having an adhesive disposed uniformly thereon to adhere to the soft tissue area of the patient's body under the mobilizing device;

decompressing the soft tissue area being treated with the mobilizing device; and manually lifting and shifting, using the gripping tab, the mobilizing device with an adjustable force to normalize the myofascial tissue being treated while the mobilizing device is adhered to the soft tissue area.

2. The method according to claim 1, wherein the step of manually lifting and shifting the mobilizing device enhances relief of the myofascial tissue imbalances.

3. The method according to claim 1, wherein the step of manually lifting and shifting the mobilizing device helps reduce a time period to normalize the myofascial tissue being treated.

4. The method according to claim 1, wherein the step of manually lifting and shifting the mobilizing device includes a flossing motion for removing or breaking up fibrous adhesions until relief occurs.

5. The method according to claim 1, wherein the step of manually lifting and shifting the mobilizing device further includes lifting, pulling, isolating, stretching, shifting, expanding, disentangling and stabilizing the myofascial tissue being treated.

6. The method according to claim 1, wherein the step of manually lifting and shifting the mobilizing device relaxes contracted muscles.

7. The method according to claim 1, wherein the step of manually lifting and shifting the mobilizing device increases circulation.

8. The method according to claim 1, wherein the step of manually lifting and shifting the mobilizing device stimulates the stretch reflex of muscles and the overlying fascia.

* * * * *